US005893997A

United States Patent [19]

Gustafsson

[11] Patent Number: 5,893,997

[45] Date of Patent: Apr. 13, 1999

[54] SPLIT CAVITY MICROWAVE OVEN HAVING A CARRIER FOR SUPPORTING A PACKAGE

[75] Inventor: Conny Gustafsson, Norrkoping, Sweden

[73] Assignee: Whirlpool Corporation, Benton Harbor, Mich.

[21] Appl. No.: 08/894,477

[22] PCT Filed: Feb. 27, 1996

[86] PCT No.: PCT/EP96/00799

§ 371 Date: Nov. 21, 1997

§ 102(e) Date: Nov. 21, 1997

[87] PCT Pub. No.: WO96/27274

PCT Pub. Date: Sep. 6, 1996

[30] Foreign Application Priority Data

Feb. 28, 1995 [SE] Sweden ..... 9500736

[51] Int. Cl.[6] ..... H05B 6/80

[52] U.S. Cl. ..... 219/756; 219/714; 219/725; 219/762

[58] Field of Search ..... 219/756, 762, 219/725, 714

[56] References Cited

U.S. PATENT DOCUMENTS

| | | | |
|---|---|---|---|
| 3,943,319 | 3/1976 | Hirai et al. | 219/756 |
| 4,481,395 | 11/1984 | Smith et al. | 219/725 |
| 4,762,973 | 8/1988 | Schultz | 219/725 |
| 4,924,048 | 5/1990 | Bunce et al. | 219/714 |
| 5,147,068 | 9/1992 | Wright | 221/9 |
| 5,498,856 | 3/1996 | Carlsson | 219/756 |
| 5,504,311 | 4/1996 | DuBuis et al. | 219/714 |

*Primary Examiner*—Philip H. Leung
*Attorney, Agent, or Firm*—Robert O. Rice; Stephen D. Krefman; Joel M. Van Winkle

[57] ABSTRACT

The invention concerns a microwave oven having an oven cavity which is split into a movable cavity part (4) integrated into the oven door (2) and a stationary cavity part (5), sectioning the cavity when the oven door (2) is opened. The oven comprises a load carrier (6) supporting a food stuff or beverage being heated in the oven the load carrier (6) is provided in either of said cavity parts such that it protrudes from the same. Thereby access to a foodstuff or beverage in the oven is facilitated without requiring a displacement of the same.

10 Claims, 3 Drawing Sheets

SPLIT CAVITY MICROWAVE OVEN HAVING A CARRIER FOR SUPPORTING A PACKAGE

FIELD OF TECHNOLOGY

The invention is directed to a microwave oven for heating foodstuff or beverages comprising an oven cavity, means for supplying microwaves to the oven cavity, a control unit for controlling the supply of microwaves to the oven cavity, a load zone in the cavity and a closing means for closing the cavity.

TECHNICAL BACKGROUND AND PRIOR ART

Generally available microwave ovens comprise a real oven means or cavity in which foodstuff or beverages may be introduced for heating, a closing means shaped as an oven door having among other things the aim of preventing leaking microwaves during operation and a load zone comprising a load carrier, frequently shaped as a rotating bottom plate, for carrying said foodstuff or beverages in the oven.

These prior art ovens have the drawback that it is difficult to obtain access to a foodstuff or a beverage being in the oven. In turn, the consequence thereof is that the cooking vessel containing said foodstuff or beverage must be brought out from the oven in order to check, stir the contents of said vessel or to obtain access to the same of other reasons.

With regard to special purpose ovens having cavities which have been shaped for receiving packages or containers of predetermined dimensions, it is a further requirement that the cavity dimensions shall have a diviation from the package dimensions which is as small as possible. From the use of such a design follows consequently that gripping of the package in a way that eliminates risks of dropping the same when it is brought out from the oven will be extremely difficult. Specifically this is the case if furthermore the temperature of the package requires a use of some kind of a heat-shield between skin and package.

U.S. Pat. No. 3,943,319 discloses a microwave oven for heating of foodstuff or beverages, comprising an oven cavity, means for supplying microwaves to the oven cavity, a control unit for controlling the generation of the microwaves supplied to the oven cavity, a load zone in the cavity, an oven front lying on an inclined plane, a horizontal load carrier arranged in said load zone for carrying said foodstuff or beverage being heated in the oven, a stationary cavity part comprising said oven front and a movable cavity part for closing the cavity by adjoining said oven front, said moveable cavity part and said stationary cavity part forming together said oven cavity, and said load carrier being arranged in said stationary cavity part.

WO 94/08459 discloses an oven with a heated interior volume and a door having a concave interior space adjacent the heated interior volume.

U.S. Pat. No. 5,147,068 discloses a vending machine provided with a microwave oven for heating and cooking foodstuff contained in trays-shaped containers.

SHORT PRESENTATION OF THE INVENTION

A first object of th e invention is to obtain a general purpose microwave oven of a design that will eliminate the above mentioned disadvantages in respect of access to cooking vessel or container the contents of which needs checking, stirring or made available of another reason.

A second object of invention is to obtain a special purpose oven of the above mentioned type and of a design that will facilitate a safe grip of the package.

Said objects are fulfilled by means of a specifically designed oven cavity and a load carrier provided therein. Said oven cavity comprises a stationary cavity part and a moveable cavity part included in said closing means, which has the consequence that a significant part of the oven cavity will be moved apart from the remainder of the oven cavity when opening said closing means. Said load carrier is provided in anyone of said cavity parts such that it protrudes from the cavity part. From this follows that the upper side of said vessel will be directly accessible to a substantial degree when the oven is open. A preferred embodiment of the invention is the use thereof in a special purpose oven of the above mentioned type because the same allows for a stable grip of said package without difficulties also in case a heat-shielding means is used between hand and package.

The split cavity concept according to the invention is specifically advantageous when used in a special purpose microwave oven having an oven cavity designed for receiving a standardized package for heating of a food-stuff or beverage therein. In this implementation the depth of said cavity parts will be rather small, e.g. 6–7 cm, allowing for the cavity parts to be manufactured each in one piece by deep-drawing of a sheet metal.

SHORT DESCRIPTION OF DRAWINGS

The invention will be more closely described in the following in relation to a non-limitative embodiment and with reference to the appended drawings, in which:

FIG. 1 discloses an embodiment of the invention implemented in a special purpose oven for heating of a standard package;

FIG. 2 discloses a more detailed embodiment of the load carrier in FIG. 1;

FIG. 3 discloses a sectional view from above of the oven cavity and its adjoining parts in FIG. 1.

DESCRIPTION OF A PREFERRED EMBODIMENT

Figure 1:
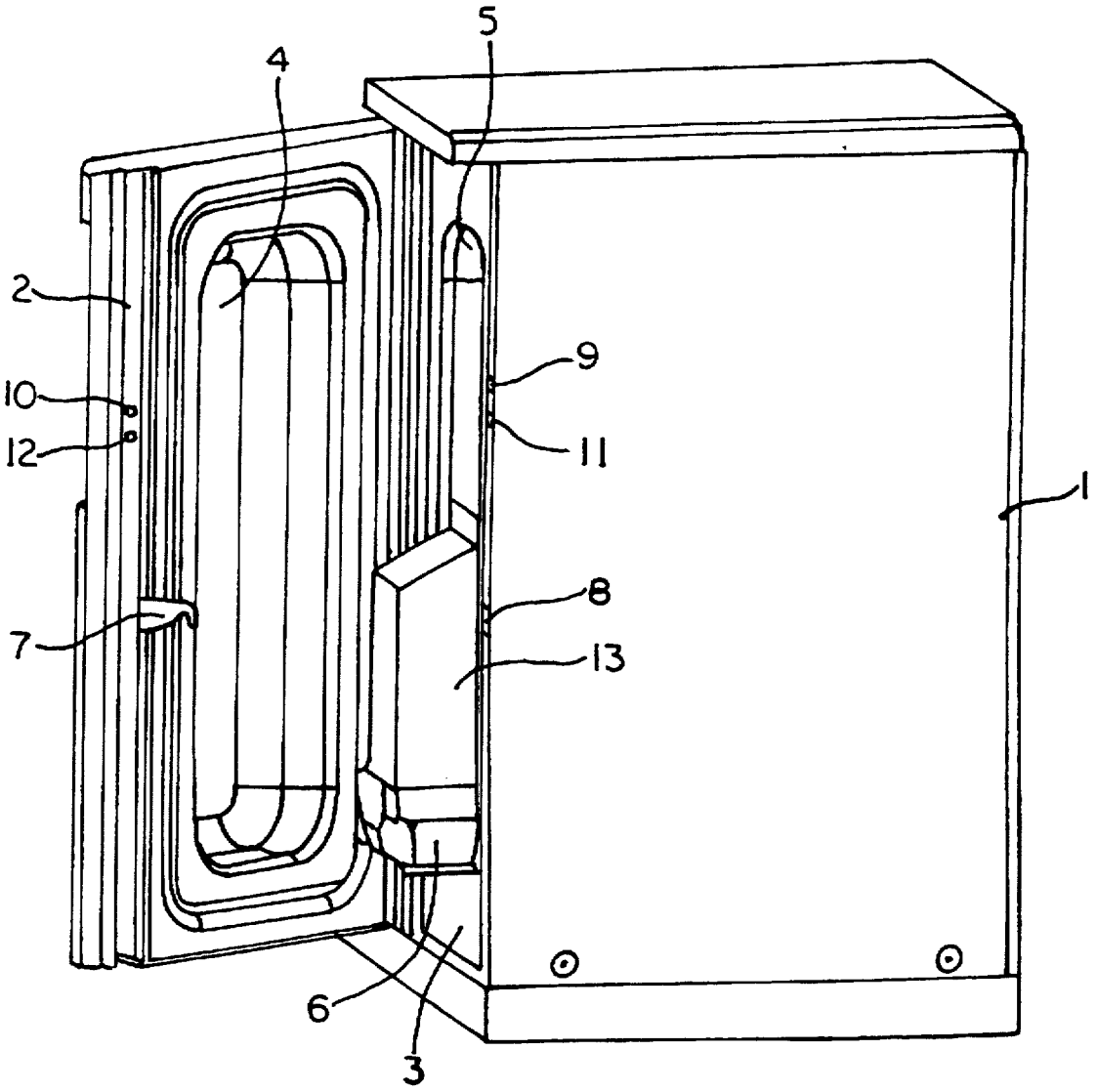

In FIG. 1 is disclosed a microwave oven which has been specifically designed for heating of foodstuff and beverages in their packages. Said specific design of the oven means that the oven cavity thereof has dimensions which have been adapted to said package such that the cavity will be substantially filled out by the same. The oven comprises a housing 1, a closing means 2, an oven front 3 adjoining said closing means 2 in the closed position of the oven, a moveable cavity part 4, stationary cavity part 5, forming together the cavity of the oven in its closed condition, a load carrier 6, protruding from the stationary cavity part for receiving and positioning of a package 13, said package being provided with a control information sensor shaped as a label (not shown) furnishing via a reading device (not shown) the oven with control information, a locking hook 7, partly holding the closing means 2 by grasping a locking mechanism indicated by 8, partly switching a customary type door switch combined therewith when closing the oven, a light emitting diode 9 for indicating an operation status of the oven, a through-light conductor 10 making the light from said light emitting diode 12 visible to the oven operator on the front side of the oven, a switch 11 for switching the oven on/off and a through-operating means 12 for operating said switch 11 from the front side.

Inside the housing 1 the oven comprises an ordinary type magnetron for generating microwaves, a microwave feed system for feeding microwaves to the oven cavity, a fan arrangement for cooling said magnetron, an electronic control unit usually microprocessor based, and a power source for supplying high voltage current to said magnetron and other operation voltages to the oven. Said components are irrelevant for a closer understanding of the invention and will therefore not be described further, but instead a reference is made to the Swedish patent SE 902128-5 describing a microwave oven of said special design.

Figure 2:
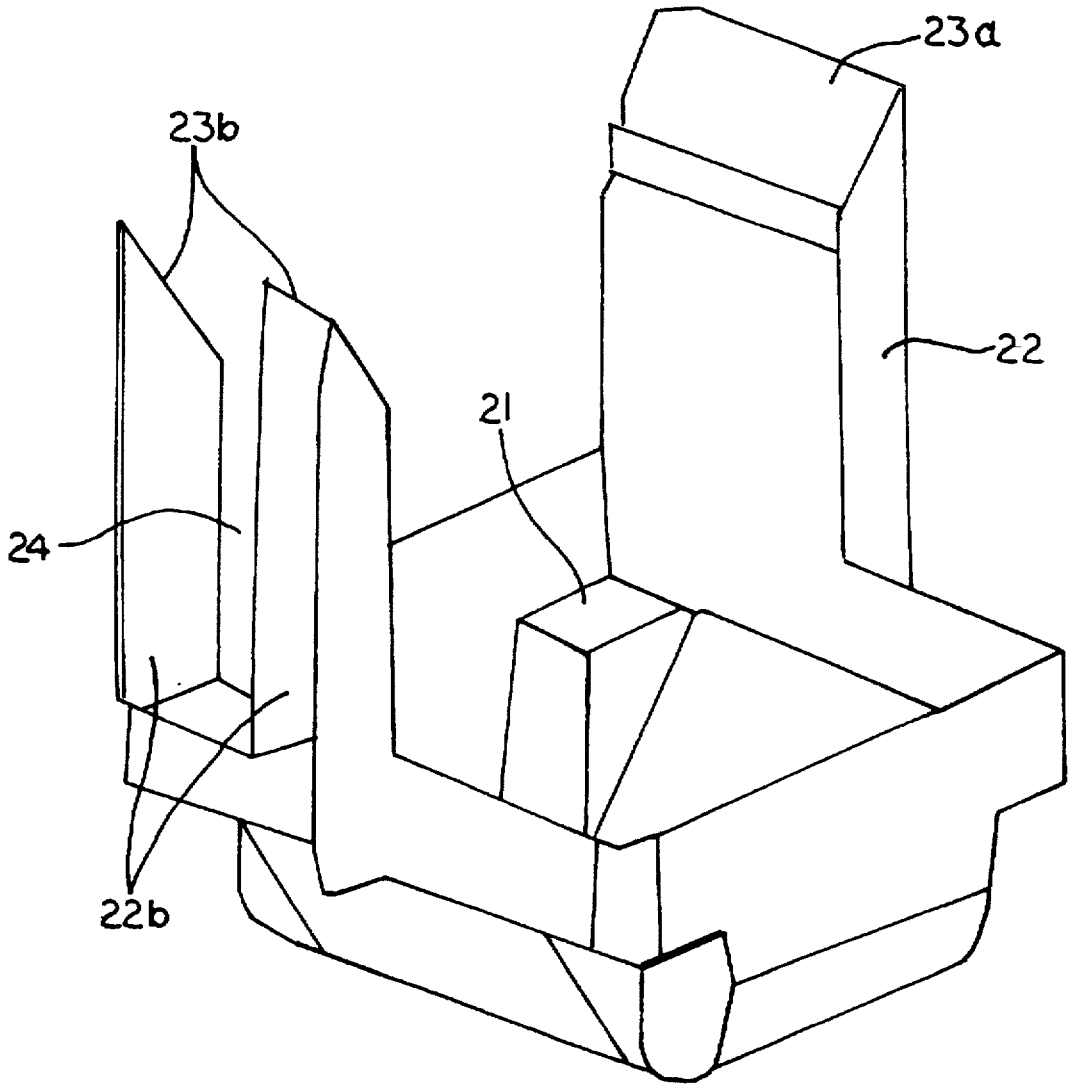

FIG. 2 discloses a preferred embodiment of a load carrier according to the invention. The load carrier is provided with shoulders 21 at the internal corners thereof, said package resting thereon when correctly positioned, to vertical side walls 22*a* and 22*b* having upper portions 23*a* respectively 23*b* which have been inclined in order to facilitate a correct introduction and positioning of the package. The side wall 22*b* is provided with an opening 24 allowing for optical reading of said label on the package, thereby furnishing control data to the microwave oven. In case said package is manufactured from a flexible material, for example of laminated paper type, the package will furthermore be strightened by said side walls 22*a* and 22*b* in such a manner that said label thereof will be adequately plained and correctly positioned in relation to said reading device.

Figure 3:
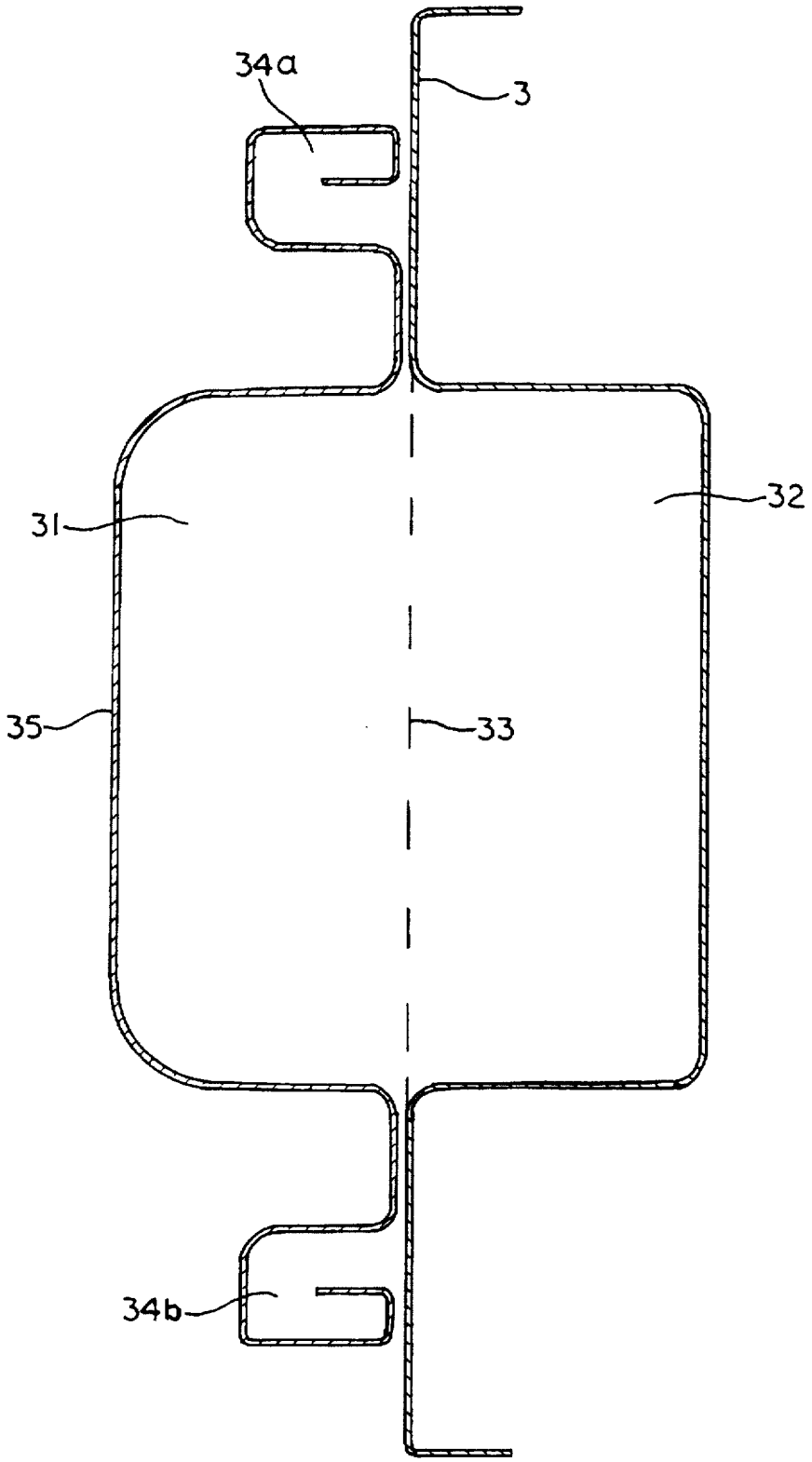

FIG. 3 is a schematic sectional view from above of the special purpose oven in FIG. 1, disclosing the oven cavity and its adjoining portions. The oven comprises a movable cavity part 31, forming the main part of said closing means 2, a stationary cavity part 32, forming the oven cavity together with said movable cavity part 31, said oven front 3 and said microwave sealing means 34*a* and 34*b* define an interface between said two cavity parts and is shown by line 33. It may be seen from the figure that one single material of sheet metal 35 has been used for manufacturing said movable cavity part 31, and furthermore comprising both of said microwave sealing means 34*a* respectively 34*b*, so called microwave chokes, further emphasizing the cost advantages of the invention. For a more detailed information about the specific construction of said chokes is referred to U.S. Pat. No. 4,645,892.

Below follows a description of the use of in first hand a special purpose oven of the type which has been disclosed above, partly a general purpose microwave oven, in which the invention has been implemented.

The description will start with the case of a general purpose microwave oven. When heating or cooking foodstuff in a microwave oven it is frequently so that it is desirable to interrupt the heating procedure in order to check, stir or supply ingredients to the foodstuff. Making this possible at prior art microwave ovens requires that the cooking vessel is brought out fully or partly from the oven, meaning unnecessary work and risks of dropping or spilling the foodstuff. These risks increase in case of relatively large quantities of food-stuff or heavy cooking vessels. In ovens having an oven door which is hinged at its lower edge, this means a special problem because a user will frequently use this door as a temporary "parking" place, which may have the consequence that the door connection parts (hinges) are destroyed, which in turn may lead to a situation in which it is not possible to close the door or a degeneration of the sealing qualities of the door. Due to the fact that an oven according to the invention is provided with a split cavity a part of the container will appear outside the stationary cavity part when opening the oven, from which follows that the upper side of the container may be accessed without difficulties and not requiring a displacement of the container. In turn, it follows therefrom that said problem will never occur.

In the following is described a use of a special purpose oven and specifically fitted standardized packages therefor. By an oven of this type a package is normally heated in one step, i.e. the package is introduced into the oven, the oven is started and you wait until a signal is generated by the oven saying that heating is ready, the package being thereafter brought out from the oven. Therefore, the difficulties that may appear when using an oven of this type are not related to possibilities of access to the upper side of the package, which is usually the case of general purpose ovens, but instead the difficulties on the whole to grip the package in such a manner that it may be brought out from the oven. These difficulties will appear because of the minimum existing space between the package and the cavity walls. This is the case of a special purpose oven according to the invention, having a space between package and cavity walls which is very small, but due to the fact that the cavity has been split into two parts and provided with said load carrier a substantial part of the package will protrude from the stationary cavity part in such a way that this part will be freely accessible when the oven door is opened.

The load carrier described above and disclosed on the drawing is fixedly arranged in the stationary cavity part. However, it will be obvious to a man skilled in the art, that said load carrier may as well be arranged in said movable cavity part, and as well that the protrution thereof may be extended or initiated by a link mechanism dependent on the movement of the moveable cavity part, alternatively being slideable outwards by hand.

I claim:

1. A microwave oven for heating of foodstuff or beverage contained in a package, the microwave oven including an oven cavity and means for supplying microwaves to the oven cavity, a control unit for controlling the generation of the microwaves supplied to the oven cavity, the microwave oven cavity comprising:

a stationary cavity part forming an enclosure, the stationary cavity having a front opening and a front surface;

a movable cavity part forming an enclosure having a rear opening, the movable cavity part being hingedly connected to the stationary cavity part wherein the movable cavity part may be rotated to a closed position wherein the openings are joined together, the stationary cavity part and the movable cavity part forming together an oven cavity when the movable cavity is in a closed position, the movable cavity may also be rotated to an open position; and a carrier for supporting the package containing foodstuffs to be heated, the carrier being supportable within the stationary cavity part and having an extending portion protruding outwardly through the front opening beyond the front surface of the stationary cavity wherein the package is supported by the carrier within the stationary cavity and has a portion which is partially outside the stationary cavity such that the foodstuffs within the package can be accessed by rotating the moveably cavity part to the open position.

2. A microwave oven as claimed in claim 1, further wherein the moveably cavity (4) and the stationary cavity part have substantially equal volumes.

3. A microwave oven as claimed in claim 1 wherein the foodstuff package is formed from relatively flexible, non-rigid plastic material, the microwave further comprising:

reading means emitting electromagnetic radiation within the infrared or visible spectrum;

a control information sensor provided on the package (13) supported by the carrier, the radiation emitted from the reading means being incident on the control information sensor, scattered radiation from the control information sensor being read by the reading means for furnishing the control unit with heating status information of the foodstuff or beverage being heated in the oven, and the carrier (6) being tray-shaped for supporting the package and comprising a vertical sidewall (22*b*) provided with an opening (24) at the level of the control information sensor, thereby allowing reading of the control information sensor by the reading device via the vertical sidewall (22*b*).

4. The microwave oven as claimed in claim 3, further wherein the tray-shaped carrier (6) comprises two opposite, substantially vertical sidewalls (22*a*, 22*b*) trimming up the side surfaces of the package (13) introduced therein such that the control information sensor obtains an adequate alignment and position in relation to the reading device, the upper sidewall parts (22*a*, 23*b*) forming a conical guide means for positioning the package bottom part correctly in the oven.

5. A microwave oven as claimed in claim 1 further wherein the stationary cavity (4) and the moveable cavity (5) are formed mainly by a deep-drawn sheet metal.

6. A microwave oven for heating of foodstuff or beverage contained in a package, the microwave oven including an oven cavity and means for supplying microwaves to the oven cavity, a control unit for controlling the generation of the microwaves supplied to the oven cavity, the microwave oven cavity comprising:

a stationary cavity part having a bottom wall, a top wall, opposite side walls, a rear wall and an open front, the open front being disposed in a vertical plane;

a movable cavity part having a bottom wall, a top wall, opposite side walls, a rear wall and an open front, the open front being disposed in a vertical plane, the movable cavity part being hingedly connected along a vertical axis to the stationary cavity part wherein the movable cavity may be rotated to a closed position such that the open fronts are joined together and the movable cavity may be rotated to an open position, the stationary cavity part and the movable cavity part forming together the oven cavity when the movable cavity is in a closed position; and a carrier for supporting the package containing foodstuffs to be heated, the carrier being supportable within the stationary cavity part and having an extending portion protruding outwardly through the side opening beyond the stationary cavity wherein the package is supported by the carrier within the stationary cavity and has a portion which is partially outside the stationary cavity such that the foodstuffs within the package can be accessed by rotating the moveably cavity part to the open position.

7. The microwave oven as claimed in claim 6, further wherein the stationary cavity part and the moveably cavity part have substantially equal volumes.

8. The microwave oven as claimed in claim 6, further comprising:

reading means emitting electromagnetic radiation preferably within the infrared or visible spectrum;

a control information sensor provided on the package supported by the carrier, the radiation emitted from the reading means being incident on the control information sensor, scattered radiation from the control information sensor being read by the reading means for furnishing the control unit with heating status information of the food stuff or beverage being heated in the oven, and the carrier being tray-shaped and having vertical sidewalls provided with an opening at the level of the control information sensor, thereby allowing reading of the control information sensor by the reading device via the vertical sidewalls.

9. The microwave oven as claimed in claim 8, further wherein the tray shaped load carrier comprises two opposite, substantially vertical sidewalls trimming up the side surfaces of the package introduced therein such that the control information sensor obtains an adequate alignment and position in relation to the reading device, the upper sidewall parts forming a conical guide means for positioning the package bottom part correctly in the oven.

10. The microwave oven as claimed in claim 6 further wherein the stationary cavity and the moveable cavity are formed mainly by a deep-drawn sheet metal.

* * * * *